US005288080A

United States Patent [19]

Tice

[11] Patent Number: 5,288,080

[45] Date of Patent: Feb. 22, 1994

[54] STROBOSCOPIC PRACTICE GOLF CLUB

[76] Inventor: David E. Tice, 16441 Lakeview Dr., Leavenworth, Wash. 98826

[21] Appl. No.: 866,997

[22] Filed: Apr. 8, 1992

[51] Int. Cl.[5] ..... A63B 69/36

[52] U.S. Cl. ..... 273/186.3; 273/186.4

[58] Field of Search ..... 273/186.1, 186.2, 186.3, 273/186.4

[56] References Cited

U.S. PATENT DOCUMENTS 3,649,028 3/1972 Worrell ..... 273/186 A
3,649,029 3/1972 Worrell ..... 273/186 C
3,753,564 8/1973 Brandell ..... 273/186 A
3,820,795 6/1974 Taylor ..... 273/186 A
4,137,566 1/1979 Haas et al. ..... 273/186.1

*Primary Examiner*—George J. Marlo

[57] ABSTRACT

3 The invention relates to a practice golf club which has strobing light sources mounted on its upper surface parallel to the club face. When swung in a dimly lit room, the strobing lights appear as a trail of spaced images which seem to hang briefly in the air. These "snapshots" of the club make readily apparent the face angle, point of impact, speed, and arcuate path of travel of the clubhead.

1 Claim, 3 Drawing Sheets

STROBOSCOPIC PRACTICE GOLF CLUB

BACKGROUND

1. Field of the Invention

This invention relates to practice golf clubs, specifically to a club which makes possible the visualization of: the arcuate path of travel of the club; the location and orientation of the club face at impact; and its speed. This new golf practice club utilizes strobing lights mounted on the top of of the club highlighting its perimeter (or a portion of its perimeter such as the face). During the golf swing, the lights turn on and off rapidly and are seen as a series of closely spaced images which seem to hang in the air briefly, apparently because of the persistence of images on the human retina.

2. Discussion of Prior Art

One problem in learning or teaching the golf swing is that the moving club is seen only as a blur due to the limitations of human sight. A golf club may average 108 mph in the impact area, with the ball remaining on the club face for only 5 msec. The teacher or student is forced to make assumptions about the golf swing based upon the reaction of the golf ball itself. If the golfer is practicing without actually hitting balls, there is even less feedback available.

The most important parameters of the golf swing are:

1) the angle of the club face at impact (open, square, or closed);
2) the arcuate path of travel of the club during impact (inside-out, outside-in, or on-line);
3) the speed of the club at impact; the location of the impact on the club face (toward the heel or toe, or centered).

If these parameters are less than nominal during the golf swing, the ball may begin its flight in the wrong direction with a possible sidespin. For example, a "slice" may result from an open club face and/or an outside-in swing path. Any device which provides feedback about the above parameters would be of benefit.

There have been previous attempts to use lights (non-strobing) to help visualize the golf swing, such as U.S. Pat. No. 3,820,795 issued to David L. Taylor on Jun. 28, 1974. His idea was the mounting of a light source to the club hosel, which serves as an indicator of the arcuate path of travel of the club. While it seems to do this well, it does not yield any information about the club face angle or speed.

Another golf practice club with lights was submitted by John R. Brandell, U.S. Pat. No. 3,753,9564, on Aug. 21, 1973. His approach uses two lights (non-strobing) mounted on top of the club, one toward the front and the other toward the rear. If the lights overlap perfectly during a swing which is neither inside-out or outside-in, then the club face alignment must be perfect. Alternatively, the lights may also overlap if the club face is not square for a swing which has an improper arcuate path (for example, an open face with an inside-out swing). This interesting approach yields information about both the swing path and club face angle, but it requires the user to analyze the light patterns to get that feedback. The club face angle can only be inferred after determining which light is proximal and which is distal, while factoring in the effect of the seen arcuate path of travel.

Yet another approach was taken by Eugene N. Worrell with U.S. Pat. Nos. 3,649,028 and 3,649,029 dated Mar. 14, 1972. He applied luminescent colored stripes to the top of the club, running parallel to the path of the swing. If the stripes appeared blurred during the swing, they must have been overlapping due to a club face angle error. As with Brandell's approach, the user must strain to get feedbacks not to mention the problems of using an ultraviolet light and gauzelike material impregnated with luminescent chemical.

Each of these previous approaches was essentially an attempt to illuminate the blur of a swinging golf club, which makes more visible the arcutate path of travel of the club. The latter two approaches additionally tried to inject some information into that blur so that the user could extrapolate and make an inference about the club face angle.

OBJECTS AND ADVANTAGES

The major contribution of the present invention is that the outline of the golf club (or part of it, such as its face) is directly and immediately observable. Specifically, several objects and advantages of my invention are to provide a self-contained practice golf club which:

a) yields information about the club face angle during the swing, especially in the impact zone;
b) yields information about the arcuate path of travel of the club throughout the swing;
c) shows the site of impact on the club face, whether it be centered or toward the heel or toe of the club;
d) yields information about the speed of the club head;
e) is portable and self-contained, requiring no additional apparatus, wiring, or chemicals;
f) is easy to use, requiring no mental gymnastics or calculations to achieve diagnostic value;
g) is similar in weighty balance, and appe&rh-nce to a real golf club; indeed, with proper engineering for shock-proofing of its electronics, this practice golf club could be used in real play.

REFERENCE NUMERALS IN DRAWINGS

Figure 1:
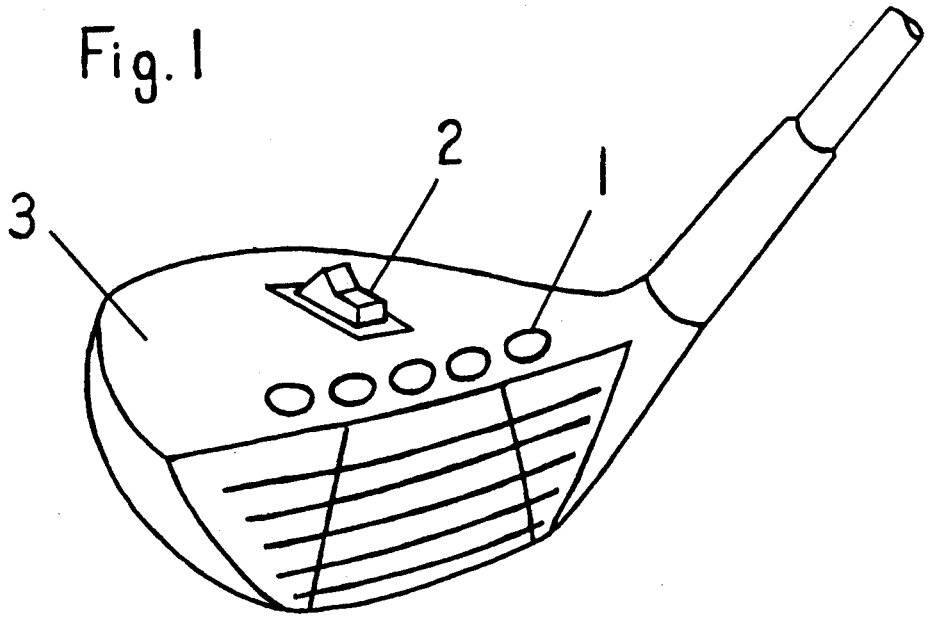
FIG. 1 shows the traditional appearance of the practice club, with the addition of a switch and light-emitting lenses on the top surface.

1: light-emitting elements
2: on/off switch
3: body of practice club (usually wood or plastic)
4: electronic circuit board
5: batteries
6: soleplate
7: soleplate screws
8: trail of lighted images
9: leading edge of lighted images
10: trailing edge of lighted images
11: simulated golf ball, either a white spot or plastic wiffle ball

DESCRIPTION OF INVENTION

An array of light-emitting elements (1) and an on/off switch (2) are the immediately observable differences between the practice club (3) and any traditional club (FIG. 1). The array of lenses should be parallel to the face of the club. Common light-emitting diodes (LED's) work well as combination light sources with lenses.

Figure 2:
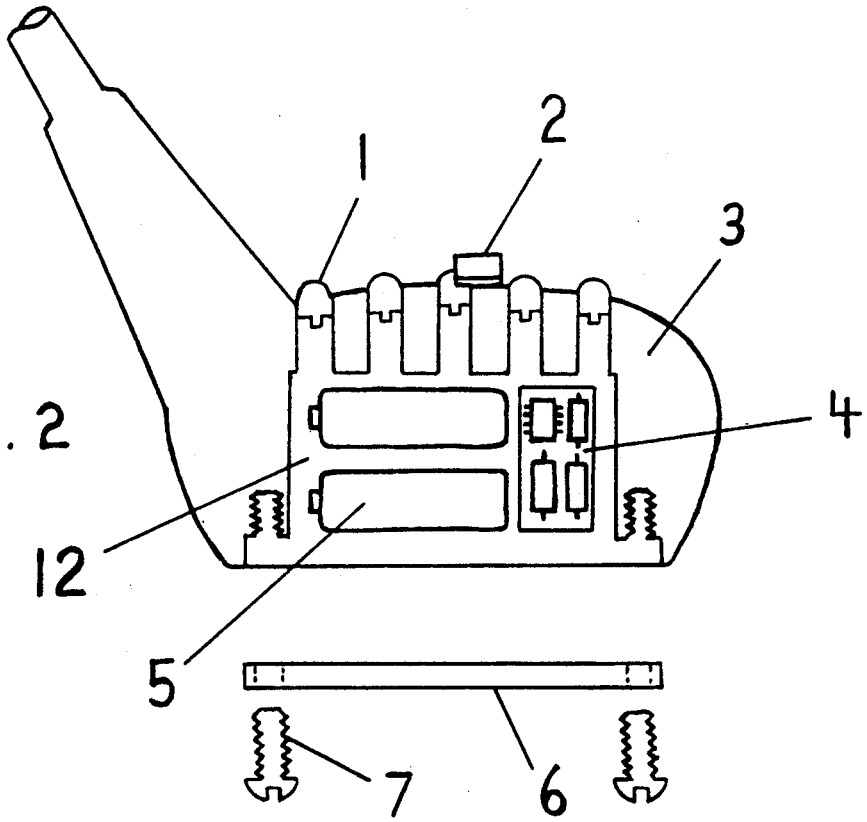
FIG. 2 is a cross-sectional view of how a standard club can be gutted to make room for electronics, batteries, and light sources.

The practice club can be constructed by removing the screws (7) and soleplate (6) from the bottom of a traditional wooden club and creating a void (12) of sufficient volume to contain batteries (5) and a small electronic circuit board (4) as seen in FIG. 2. Holes can be drilled through to the upper surface for mounting of the light sources/lenses and switch.

OPERATION OF INVENTION

Figure 3:
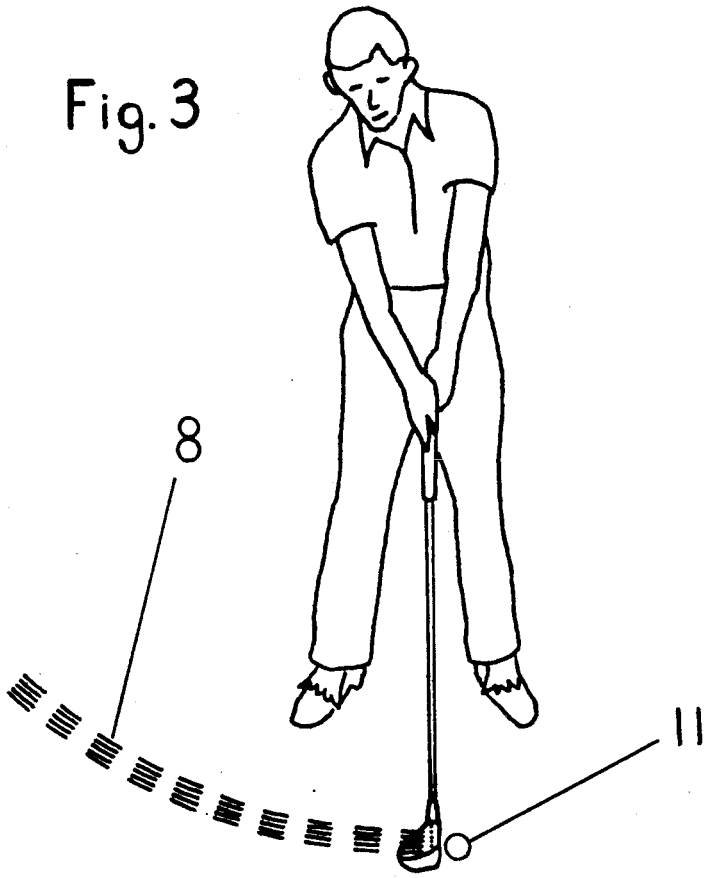
FIG. 3 depicts the trail of images which seem to hang in the air behind the club because of persistence of images on the human retina.
Figure 4:
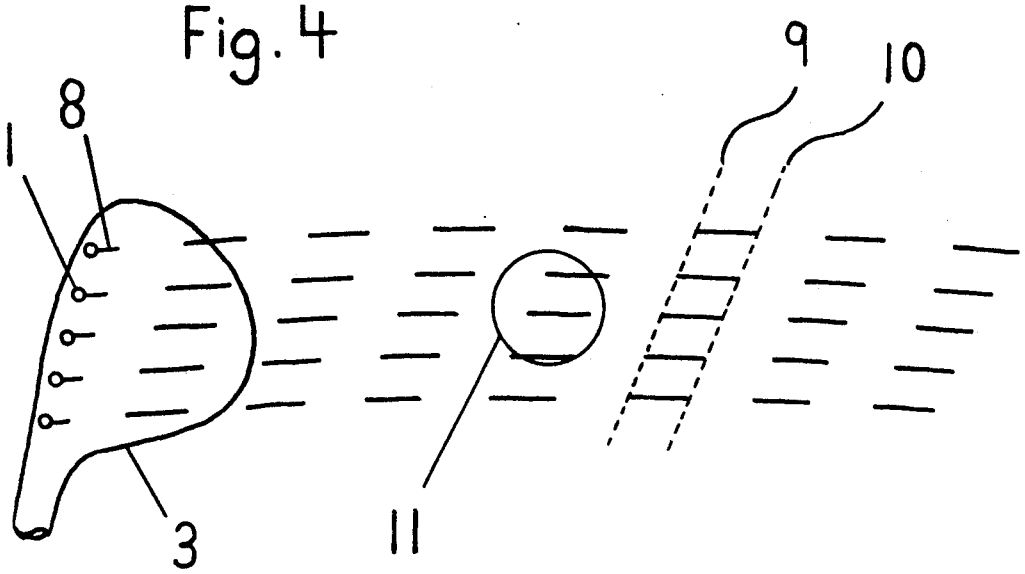
FIG. 4 shows the trail of images being formed while making a faulty swing with the club face slightly open.
Figure 5:
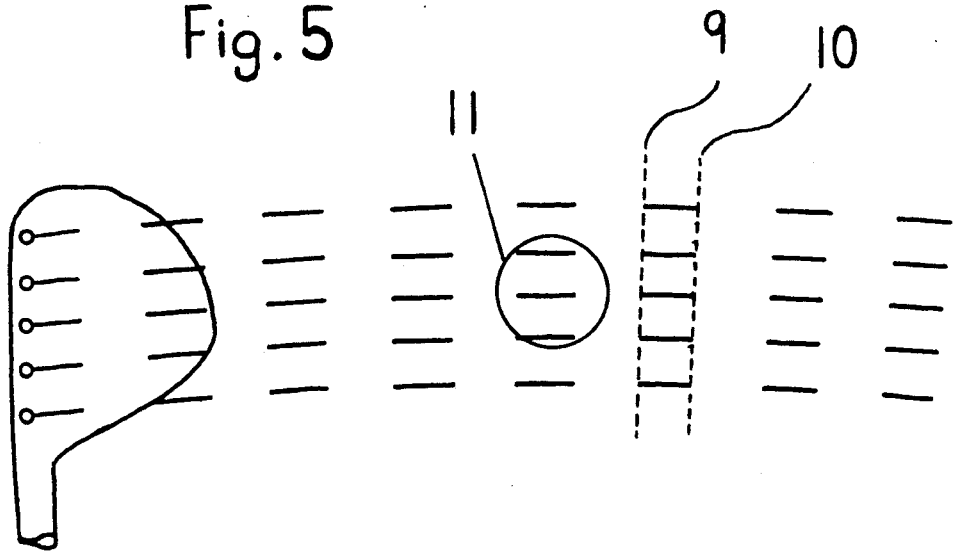
FIG. 5 shows the trail of images being formed while making a good swing with the club face square to the target.

During the swing, the light sources turn on and off with a duty cycle of approximately 50 % and the user observes a trail of lighted images (8, FIG.3) which seem to hang briefly in the air behind the practice club. The trailing edge (10, FIG. 4) of each image is created when the light sources turn on simultaneously. The leading edge (9, FIG. 4) of each image is created when the light sources turn off, again simultaneously. If the leading and trailing edges are perpendicular to the target line, then the club face was square at impact (FIG. 5). Otherwise, the face is easily seen as open or closed to the target line. FIG. 4 shows the resultant image pattern from an open-faced club. No interpretation is required on the part of the user. It is important that the light sources turn on and off simultaneously because the leading and trailing edges indicate the club face angle to the user. This is easily achieved by passing a common electrical current through all light sources. The speed of the golf club and the duration of current together determine the length and spacing of the lighted images. For an average golfer, a frequency of 500 Hz provides a nicely readable display of images. The circuit can be designed with an adjustment knob accessible to the user for fine-tuning of the frequency to meet individual needs. The light sources are intended to indicate the orientation of the club head and so must accurately define the perimeter of the club head or a portion thereof. A single row of LED's aligned with the club face works well. It is probably best to use yellow LED's because of the heightened sensitivity of the human eye to that frequency of light. If the LED in the middle of the array is chosen to be a different color, such as red or green, the point of impact is more easily discerned with respect to the center of the club face.

The practice club is used in a dim or dark room because a dark background facilitates viewing of the image trail. When the current through the light sources is adjusted so that the trail of images is nicely viewable, the brightness of the motionless practice club can be disconcerting. To allow the eyes to be adjusted to both a moving and a motionless-club, it is recommended that a centripetal switch be installed in the practice club with the purpose of boosting the current to the light sources while a swing is in progress. Such a switch allows the motionless light sources to be operated at a more comfortable intensity, while later yielding a nicely viewable trail of images. Alternatively, a centripetal switch could be used to keep the light sources turned off until a swing was in progress. This would solve the eye adjustment problem and increase battery life. It is also possible to install adjustment knobs with which the user can fine tune the brightness of both the moving and motionless club to individual needs and environmental conditions.

By swinging the practice club at a white circle (11) on the floor which represents the golf ball, the user can tell where on the club face the impact would have occurred. Alternatively, the user could swing at a plastic wiffle ball. In a very dark room, it is possible to use luminescent paint on either the painted spot or the wiffle ball so that it can be seen. Further, it helps to have a straight white line painted on the floor pointing at the imaginary target and going through the middle of the white spot or under the wiffle ball. The trail of images will hang over this white line and the arcuate path of the club is more evident, showing whether the swing was inside-out, outside-in, or on-line.

The length and spacing of the images varies with club head speed. The user knows that his/her club head speed is getting faster when the images and spaces are becoming wider.

With miniaturization and hardening of components, it should be possible for the practice club to survive play with real golf balls. It should also be easy to adapt the stroboscopic concept to irons as well as woods. It is possible to locate the light sources on the iron club head and place the other components in the handle of the club.

Conclusions, Ramifications, and Scope of Invention

Thus the reader will see that the golf practice club affords immediate feedback about the most important parameters of the golf swing. It is easy to make and to use the stroboscopic practice golf club.

While my above description is specific about many details, these should not be construed as limiting the scope of the invention, but rather as one possible implementation thereof. For example, the practice club might be used outdoors in bright sunlight if special glasses are worn to filter out all light except that emitted by the strobing light sources on the club. Alternatively, a club could be designed which uses reflected sunlight as a light source, with a rotating mirror on top of the club providing the stroboscopic effect.

The use of strobing lights to outline the perimeter of the moving object could be extended to other sports such as tennis, where the frame of the tennis racket could have light sources embedded within it. The idea is that the strobing lights make visible for inspection that which is otherwise a blur, such as the swinging golf club.

I claim:

1. A practice golf club comprising
   a. an elongated shaft,
   b. a head mounted on one end of said shaft,
   c. at least two light source(s) mounted in said head and visible by the user which
      (1) highlight the face angle of said head, and which
      (2) turn on and off rapidly and simultaneously, such that
      (3) said light sources produce spaced, non-overlapping stroboscopic images when said club is swung at normal speed,
   d. battery and electronic devices located inside said head which include means to
      (1) provide current for simultaneous activation of said light sources, and which
      (2) control timing of said current so that a stroboscopic effect is achieved with said light sources.

* * * * *